United States Patent [19]

Weman

[11] 4,069,559

[45] Jan. 24, 1978

[54] FERRULE BUCKLE

[75] Inventor: Per Olof Weman, Hasloh, Germany

[73] Assignee: N.V. Klippan S.A., Haasrode, Belgium

[21] Appl. No.: 663,636

[22] Filed: Mar. 4, 1976

[51] Int. Cl.[2] ..... A44B 11/26; A44B 11/00

[52] U.S. Cl. ..... 24/230 A

[58] Field of Search ..... 24/230 AU, 230 AT, 230 A

[56] References Cited

U.S. PATENT DOCUMENTS

| | | | |
|---|---|---|---|
| 3,427,694 | 2/1969 | Bullock | 24/230 A |
| 3,499,193 | 3/1970 | Hatfield | 24/230 A |
| 3,945,091 | 3/1976 | Farlind | 24/230 A |
| 3,955,056 | 5/1976 | Lindblad | 24/230 A |

FOREIGN PATENT DOCUMENTS

| | | | |
|---|---|---|---|
| 761,152 | 6/1967 | Canada | 24/230 A |
| 270,228 | 2/1914 | Germany | 24/230 A |
| 953,572 | 3/1964 | United Kingdom | 24/230 A |

*Primary Examiner*—Bernard A. Gelak

*Attorney, Agent, or Firm*—Roger H. Criss

[57] ABSTRACT

A buckle and tongue combination comprising a ferrule, channeled for acceptance of a bifurcated tongue. A latch member straddling the ferrule, and pivoted thereto, is biased for latching engagement with the tongue. The tongue may be disengaged by pressure in opposition to the bias, applied to a lever which constitutes an extension of the latching member.

24 Claims, 5 Drawing Figures

FERRULE BUCKLE

CROSS-REFERENCE TO RELATED APPLICATIONS

This application is related to a U.S. patent application Ser. No. 663,943 entitled "Ferrule Buckle Having Pin Latch and Through Slot", filed in the name of R. L Stephenson and J. Schotthoefer and U.S. patent application Ser. No. 663,942 entitled "Ferrule Buckle with Sliding Release Button", filed in the name of R. L. Stephenson, both filed concurrently herewith on Mar. 4, 1976.

BACKGROUND OF THE INVENTION

1. Field of the Invention

This invention relates to a buckle and tongue combination of the type used in automobiles, airplanes and other vehicles for retaining an occupant in a seated position within the vehicle. With many of these the buckle is attached to the frame or body of the vehicle by a relatively short rigid or semi-rigid connector, and the cooperating tongue is attached to one or two flexible restraints disposed over the lap, or the lap and chest of the user, and also attached to the body or frame of the vehicle. In other passenger restraint systems both tongue and buckle are attached to flexible restraints which are attached to the frame or body of the vehicle. These are buckled together across the lap or the lap and chest of the user.

2. Description of the Prior Art

A large number of such buckle and tongue combinations are found in the prior art, practically all of which incorporate a buckle having some type of latching means co-acting with a tongue. Many of these have an independent latching member within a cast metal or predominantly plastic housing, and frequently the connection between the release button or lever, and the latching member is indirect. A ferrule is disclosed in U.S. patent application Ser. No. 621,971 as a mounting means for a buckle.

It is an object of the present invention to provide very simple and positive means for latching the tongue, and to provide for its release with a minimum of effort even under conditions of great stress. It is also an object of the present invention to provide a buckle which in operation is completely independent of an outer case or housing. In the buckle and tongue combination of this invention, the security of the latched tongue within the buckle does not depend on the integrity of an outer housing. An outer housing, if provided to present a finished and decorative appearance to the buckle need not carry the structural strength and relative high cost of those prior art systems wherein the housing is essential to the operation of the mechanism within.

SUMMARY OF THE INVENTION

The present invention is directed to a simple, functional and rugged positive-acting buckle and tongue in combination, independent of any decorative housing in which it may be contained. The tongue can be released from the buckle by a relatively small force. The invention comprises an elongated ferrule to which a restraint, such as a cable, is permanently affixed. The tongue latches to the ferrule, so that a direct connection is had between the tongue and the restraint attached to the ferrule.

Briefly, the buckle and tongue combination of my invention comprises a ferrule having longitudinal channels for guiding a bifurcated tongue at one end, and means at the other for the attachment of a restraint. The legs of the bifurcation of the tongue are separated by a distance greater than the width of the ferrule, and have at their ends, inwardly directed projections separated by a distance less than the width of the ferrule, for sliding engagement with the longitudinal channels of the ferrule. A latch member, closely straddling the ferrule, has a latching tooth extending downward therefrom on each side of the ferrule. The overall width of the toothed portion of the latching member is slightly less than the distance between the legs of the bifurcated tongue. The latch member is pivotally attached to the ferrule to allow movement of the latching teeth in and out of engagement with the tongue. Biasing means act on the latch member to urge the latching teeth to their latched position. A release lever attached to the latch member extends beyond the pivot, whereby pressure on the lever in opposition to the bias disengages the latching teeth from the tongue, thereby permitting its withdrawal from the buckle.

Preferably, the release lever is an integral part of the latch member, and extends a greater distance beyond the pivot point toward the rear, than the latching teeth extend toward the front, so that the latching teeth and the lever constitute a single integral unit straddling the ferrule, and leverage is obtained in removing the latching teeth. It follows then, that very little pressure is required to release the tongue, even when the tongue and buckle are under great stress. The lathing of the tongue is positive and direct, and its unlatching is accomplished at a mechanical advantage.

DETAILED DESCRIPTION OF THE PREFERRED EMBODIMENT

Figure 1:
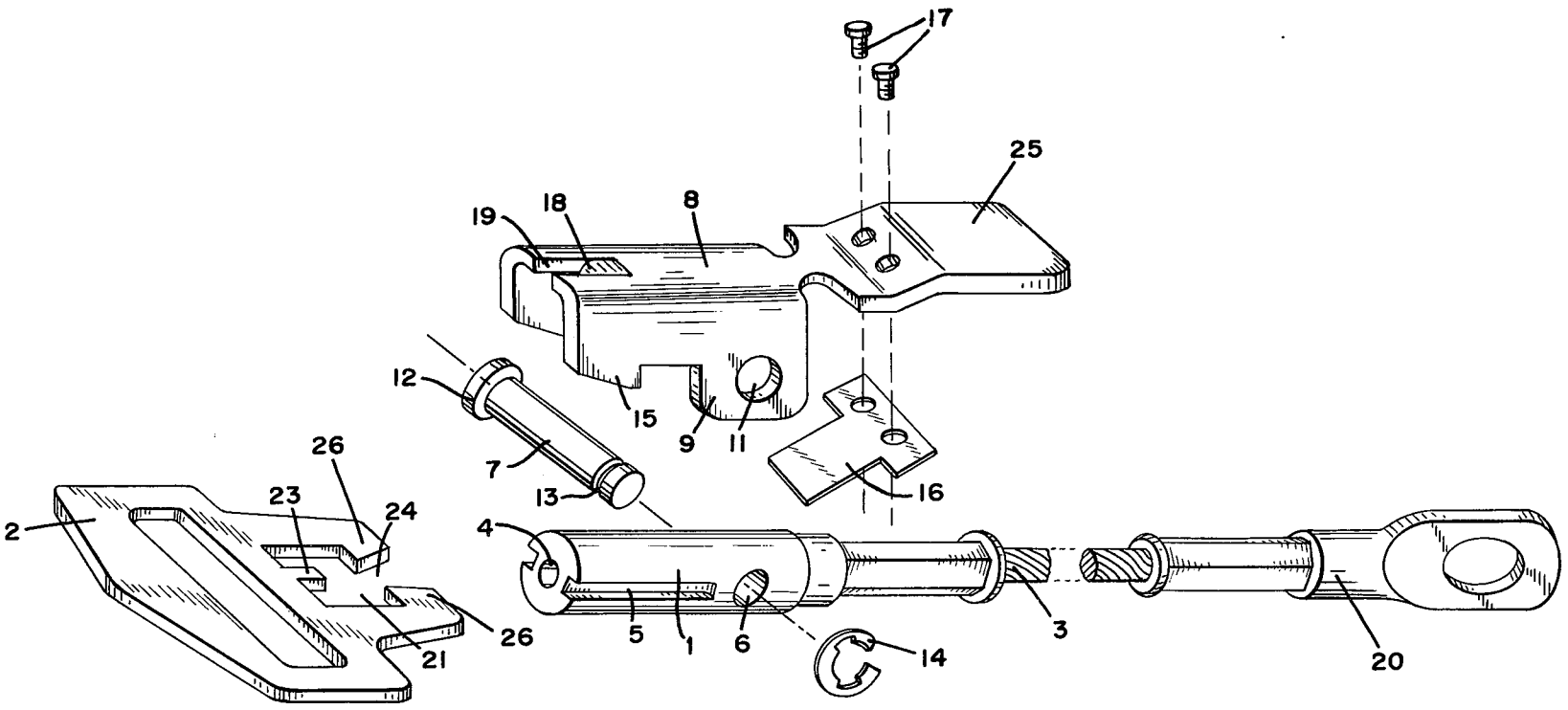
FIG. 1 is an exploded view of the working parts of a seat belt buckle and tongue combination of the present invention.
Figure 2:
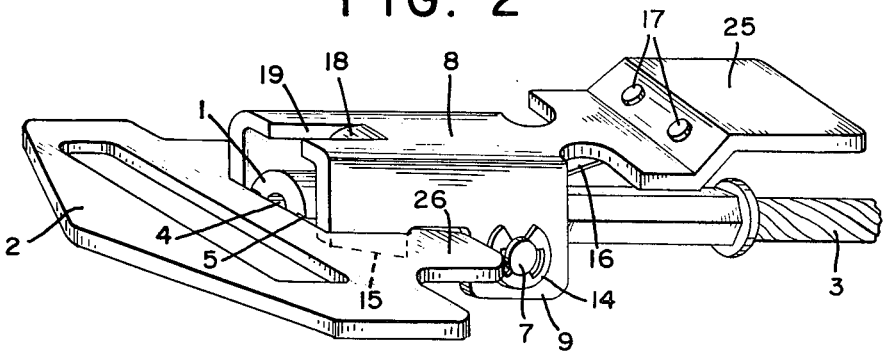
FIG. 2 is a perspective view of the assembled buckle with the tongue latched into place.
Figure 3:
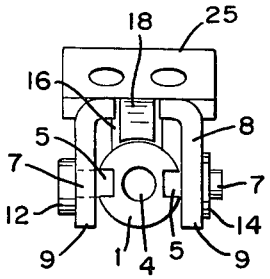
FIG. 3 is a front view in elevation of the buckle drawn to show how the central down-turned projection of the latch member serves to position the latching teeth of said latch member.

With reference to the five figures, my invention is directed to a safety seat belt buckle and tongue combination comprising a ferrule 1 provided with means at its front end for engaging or disengaging a tongue 2, and at the other end, means for the fixed attachment of a seat belt or other restraint 3.

By the term "ferrule" I mean in this instance, a connecting member which forms the link between the tongue when engaged thereto, and a cable, belt or other passenger restraint. The general shape of the ferrule is not critical, but preferably it is substantially cylindrical.

In the embodiment of the drawings, the ferrule 1, preferably fabricated of metal, receives the tongue 2 at its front end, and is attached at the rear to a restraining cable 3. In the front end of the ferrule there is an opening 4 which extends a short distance into the ferrule.

On opposite sides of the front end of the ferrule there are channels 5, having a width slightly greater than the thickness of the tongue, and extending back, parallel to each other and to the ferrule for a distance at least equal to the depth of that portion of tongue 2 to be inserted.

At a point just beyond the channels there is a cylindrical opening 6 extending perpendicularly through the ferrule to receive a pivot pin 7. This opening lies in a plane parallel to a plane extending through both channels 5.

An elongated latching member 8 comprises a front and rear section. The front comprises a tunnel-shaped section having a U shaped cross section, the inside width of which is slightly greater than the width of the ferrule, so that it can straddle the ferrule, with its front end extending substantially to the front end of the ferrule. The rear portion of this forward section extends below the ferrule forming two legs 9, through each of which there is a circular opening 11 aligned with the cylindrical opening 6 in the ferrule. Pivot pin 7 having a head 12 at one end and a groove 13 to accept split washer 14 at the other, extends through the aligned openings and is secured by the application of split ring 14. The tunnel of the front section of latch member 8 extends a short distance above the ferrule, so that the latch member can be made to rock to a limited degree about the pivot pin 7 as an axis.

The front portion of the forward section of the latch member also has two legs which extend downward to form the latching teeth 15 of the latch member.

The latch member has biasing means to retain it with its front section down. In the drawing this bias is supplied by a flat metal spring 16 attached to the undersurface of the rear section of the latch member by rivets 17. This spring presses against that portion of the ferrule which lies beneath it. The latch member is limited in the degree to which the bias forces the front section and the latching teeth 15, downward. This limit can be fixed by the contour of the latch member, or by a projection 18 extending from its front, or its under surface. In the embodiment shown, parallel cuts 19 have been made in the top of the front section, extending back a short distance, and the strip between these cuts has been bent downward to touch the top surface of the ferrule 1 and thus act as a stop to the downward movement of the front end of the latch member 8. When the latch member is in this latched position, with the latching teeth 15 held downward to a limited extent by the bias of spring 16, the rear edge of each latching tooth 15 extends substantially to the bottom edge of its adjacent channel 5. The bottom surfaces of these latching teeth are not parallel to the channels, however, but slope downward, so that the leading edge of each tooth is substantially on a plane with the upper edge of its adjacent channel 5. Thus the tongue 2 when inserted into the channels and guided thereby, encounters the sloping undersurface of the latching teeth 15 and forces them upward against the bias of spring 16.

The forward section of tongue 2 which is to be inserted into the buckle, has a rectangular opening 21 slightly longer than the depth of teeth 15 of the latch member, and slightly wider than the outside distance between the two latching teeth. To the rear of this rectangle there extends outward from the center of the rear wall of the rectangle, a short projection 23 which can be accommodated by opening 4 when the tongue is inserted into the buckle. Opposite this projection there is an open passage 24 in the front central portion of the rectangle 21, having a minimum width only slightly greater than the distance between the floor of the two channels. From this minimum width of passage 24, the passage flares outward to a width only slightly less than that of the ferrule, to increase the ease with which the tongue can be inserted into the buckle.

The rear section of latch member 8 is angled upward, then backward, substantially parallel to the ferrule. It presents a flat surface or "push button" as a release lever. By manually pressing this release lever 25, the latch member 8 is rocked back against the bias of spring 16 to thus raise latching teeth 15 to a degree where the lowest points of the latching teeth are above the upper edges of channels 5. Fitting 20 of FIG. 1 represents one way in which restraint 3, in this illustration a short semi-rigid steel cable, can be crimped into a fitting 20, for fastening to the frame or body of a vehicle.

Figure 4:
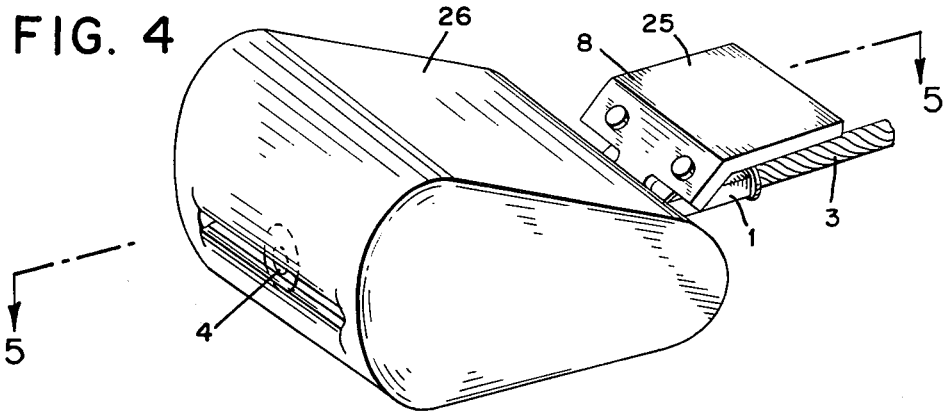
FIG. 4 is a perspective drawing of the seat belt buckle enclosed in a housing.

FIG. 4 illustrates one way in which the buckle can be enclosed in a housing 26 which is contoured in the front end to guide and direct the inserted tongue 2 to the channels 5 of the ferrule within. The buckle mechanism, however, is completely operable without the housing.

Figure 5:
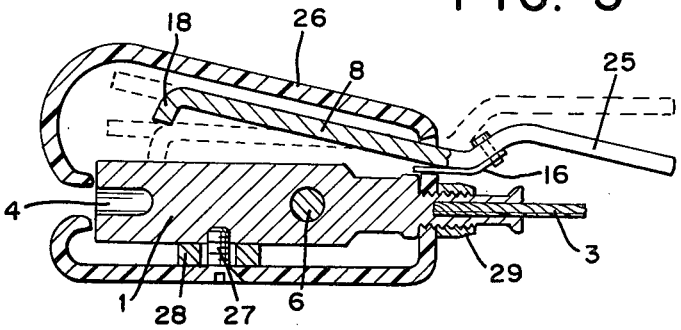
FIG. 5 is a vertical half-section through the line 5—5 of FIG. 4, with the buckle in its release position with the release lever depressed.

FIG. 5 is a vertical half-section of the buckle of FIG. 4 taken along line 5—5. It shows one way in which the ferrule and attached components can be fixed within a housing. A washer-shaped spacer 28 can be used to align the ferrule. The rear end of the ferrule is threaded and extends through an opening in the rear of the housing. A nut 29 engages the threads of the rear end of the ferrule and tightens the ferrule against the end of the housing, support within being provided by the concentric shoulder 31 on the ferrule.

In operation, tongue 2 is inserted so that opposing projections 26 at each side of opening 24 slip into channels 5. As they encounter the sloping teeth 15, they raise the teeth against the bias of spring 16 and slip under them. Since the rectangular opening 21, as stated, is slightly wider than the outside width of teeth 15, and slightly deeper than these teeth, two narrow rectangular openings extend on each side of the ferrule into which the latching teeth drop, urged by the bias of spring 16, thus latching the tongue to the ferrule. The tongue can now be freed by applying pressure to release lever 25. This pressure, applied against the bias of spring 16, raises the latching teeth, freeing the tongue.

If desired, the teeth 15 can be positioned with their forward surface extending below the upper edge of the channels 5, so that the tongue 2 cannot be inserted unless the release lever 25 is first depressed.

In a prototype buckle and tongue combination, the inside distance between the legs of the bifurcation of the tongue is 21 mm, their length 25 mm, but of this length, the last 9 mm constituting their tips, extends symmetrically, inwardly toward each other, approaching within 11 mm at their tips, but narrowing smoothly to a minimum distance of 9 mm. The thickness of the bifurcated tongue is just under 3 mm. The ferrule is 14 mm in diameter at the front end, and retains this diameter for the first 40 mm of its 74 mm length. The channels to receive the bifurcated tongue extend back 25 mm and are 3 mm wide, to readily accept the tongue. These channels are separated by a distance of 8 mm as measured through the ferrule.

The latching member is stamped and cut from 3 mm sheet metal stock, and has an inside width of 21 mm. Therefore, when the tongue is inserted onto the ferrule, rectangular openings are exposed on each side of the tongue, about 3.5 mm wide and 16 mm long. It is into these exposed openings that the latching teeth are urged by the biasing spring, to latch the tongue to the buckle.

The pivot pin is 6 mm in diameter, and extends through the ferrule to place its axis 34 mm from the front end of said ferrule. The rear edge of the latching teeth at the point where they retain the tongue is 19 mm from the pivot point, whereas the release lever extends oppositely for an overall distance of 56 mm from the pivot point, thereby providing a mechanical advantage for the release of the tongue.

While I have described preferred embodiments of my invention, it will be understood that various modifications can be made in the buckle and tongue combination described, without departing from the spirit of the invention or the scope of the following claims:

I claim:

1. A buckle and tongue combination comprising:

a. an elongated, substantially cylindrical member having guiding means at one end for guiding a tongue and means at the other end for the attachment of a passenger restraint;

b. a tongue having legs separated by a distance greater than the width of the elongated member, said legs having engaging means for sliding engagement with the guiding means of the elongated member;

c. a latch member pivotally mounted on the elongated member and having at least one latching tooth to engage the tongue;

d. biasing means mounted on the elongated member for urging the latching tooth into engagement with the tongue; and e. a release lever attached to the latch member, whereby pressure on said lever in opposition to the biasing means disengages the latching tooth from the tongue, allowing its withdrawl from the buckle.

2. The buckle and tongue combination of claim 1 wherein: said guiding means at one end of said elongated member for guiding said tongue are longitudinal channels.

3. The buckle and tongue combination of claim 2 wherein said tongue has two legs, inwardly directed projections on said legs, said legs separated by a distance less than the width of the elongated member, for sliding engagement with the longitudinal channels of the elongated member;

4. The buckle and tongue combination of claim 1 wherein said latch member has two latching teeth extending downward therefrom, one on each side of the elongated member, to engage the tongue.

5. The buckle and tongue combination of claim 1 wherein the passenger restraint is a cable attached to the elongated member by crimping.

6. The buckle and tongue combination of claim 1 wherein there is a concentric opening in the front end of the elongated and a corresponding projection midway between the legs of the bifurcation of the tongue for engagement by said concentric opening on insertion of the tongue.

7. The buckle and tongue combination of claim 4 wherein the bottom surface of each latching tooth slopes downward from a point just above the upper edge of the channel, to a point at about the lower edge of the channel when each tooth is disposed in its latched position, whereby insertion of the tongue forces the latching teeth upward against the bias.

8. The buckle and tongue combination of claim 7 wherein the bias is supplied by a flat metal spring acting between the release lever and the surface of the elongated members.

9. The buckle and tongue combination of claim 4 wherein the downward movement of the latching teeth is limited by a projection extending downward from the undersurface of the front end of the latch member, which contacts the top surface of the elongated member.

10. The buckle and tongue combination of claim 4 wherein the latch member is a unitary structure formed from sheet metal, and the downward movement of the teeth is limited by a downward projecting strip of the latch member, curved downward, to contact the upper surface of the ferrule when the latch member is in its latched position.

11. The buckle and tongue combination of claim 1 wherein the latch member has two legs extending downward to a point below the longitudinal axis of the elongated member to straddle the elongated member, said latch member legs having aligned openings which coincide with a transverse opening through the elongated member in substantially the same plane as that of the two channels, said transverse opening and the opening of the legs of the latch member being journaled on a pivot pin extending therethrough.

12. The buckle and tongue combination of claim 1 wherein the buckle is enclosed in a housing having an opening in one end for directing the tongue to the elongated member within, said housing having means for the attachment of said elongated member, and an opening to expose the release lever, to allow release of the tongue.

13. A buckle and tongue combination comprising:

a. a ferrule having a passenger restraint attached at its rear end, and having a channel at its front end, parallel to the ferrule on each of the two opposite sides, extending at least partially toward the rear end;

b. a tongue having a bifurcation for engaging the ferrule, the thickness of the bifurcated portion of the tongue being slightly less than the width of the channels of the ferrule, the bifurcation having legs on their inner edges parallel and separated by a distance greater than the width of the ferrule, said legs having at their ends, symmetrical projections extending inwardly, separated by a distance slightly greater than the distance between the channels of the ferrule measured through the ferrule, whereby these projections can be slideably inserted into the channels leaving openings exposed on each side of the ferrule, said openings extending to the inner edges of the legs of the bifurcation;

c. an elongated latch member having a forward section with a U shaped cross section straddling the ferrule down to about the top edge of the channels, and latching teeth extending from the sides of the forepart of this forward section downward to about the bottom edge of the channel to engage said exposed openings of the inserted tongue, the rear part of the forward section of the latch member having legs extending below the longitudinal axis of the ferrule and pivoted thereon for limited rotation sufficient to allow the latching teeth to be moved in and out of latching engagement with the tongue, a rear section of the latch member having a release lever for rocking the pivoted latch member out of a latching engagement with the tongue; and d. biasing means maintaining the latching member in its latched position.

14. A buckle comprising: an elongated, substantially cylindrical ferrule, channeled on opposite sides at one end for engaging a bifurcated tongue, and a latch member with at least one latching tooth, said latch member straddling the ferrule and pivoted thereto for rotation in and out of latching engagement with corresponding openings in the tongue, said latch member being biased to its latched position and having a lever extended therefrom for the manual release of the tongue.

15. A buckle and tongue combination comprising:

a. a ferrule having longitudinal channels at one end for guiding a tongue and means at the other end for the attachment of a passenger restraint;

b. a tongue having two legs separated by a distance greater than the width of the ferrule, said legs having at their ends, inwardly directed projections separated by a distance less than the width of the ferrule, for sliding engagement with the longitudinal channels of the ferrule;

c. a latch member pivotally mounted on the ferrule, having at least one latching tooth to engage the tongue;

d. biasing means mounted on the ferrule for urging the latching tooth into engagement with the tongue; and e. a release lever attached to the latch member, whereby pressure on said lever in opposition to the biasing means disengages the latching tooth from the tongue, allowing its withdrawal from the buckle.

16. The buckle and tongue combination of claim 15 wherein said latch member has two latching teeth extending downward therefrom, one on each side of the ferrule, to engage the tongue.

17. The buckle and tongue combination of claim 15 wherein the passenger restraint is a cable attached to the ferrule by crimping.

18. The buckle and tongue combination of claim 15 wherein there is a concentric opening in the front end of the ferrule and a corresponding projection midway between the legs of a bifurcation of the tongue for engagement by said concentric opening on insertion of the tongue.

19. The buckle and tongue combination of claim 15 wherein the bottom surface of each latching tooth slopes downward from a point just above the upper edge of the channel, to a point at about the lower edge of the channel when each tooth is disposed in its latched position, whereby insertion of the tongue forces the latching teeth upward against the bias.

20. The buckle and tongue combination of claim 15 wherein the biasing means is a flat metal spring acting between the release lever and the ferrule.

21. The buckle and tongue combination of claim 15 wherein the downward movement of the latching teeth is limited by a projection extending downward from the undersurface of the front end of the latch member, which contacts the top surface of the ferrule.

22. The buckle and tongue combination of claim 15 wherein the latch member is a unitary structure formed from sheet metal, and the downward movement of the teeth is limited by a downward projecting strip of the latch member, curved downward, to contact the upper surface of the ferrule when the latch member is in its latched position.

23. The buckle and tongue combination of claim 15 wherein the latch member has two legs extending downward to a point below the longitudinal axis of the ferrule to straddle the ferrule, said latch member legs having aligned openings which coincide with a transverse opening through the ferrule in substantially the same plane as that of the two channels, said transverse opening and the opening of the legs of the latch member being journaled on a pivot pin extending therethrough.

24. The buckle and tongue combination of claim 15 wherein the buckle is enclosed in a housing having an opening in one end for directing the tongue to the ferrule within, said housing having means for the attachment of said ferrule, and an opening to expose the release lever, to allow release of the tongue.

* * * * *

UNITED STATES PATENT AND TRADEMARK OFFICE

CERTIFICATE OF CORRECTION

PATENT NO. : 4,069,559

DATED : January 24, 1978

INVENTOR(S) : Per Olof Weman

It is certified that error appears in the above-identified patent and that said Letters Patent are hereby corrected as shown below:

Column 2, line 33, "lathing" should read -- latching --.

Column 5, line 38, "withdrawl" should read -- withdrawal --.

line 44, after "legs," insert -- said engaging means comprising --.

Column 5, line 58, after "elongated" insert -- member --.

Column 6, line 4, "members" should read -- member --.

Signed and Sealed this

Ninth Day of May 1978

[SEAL]

Attest:

RUTH C. MASON
Attesting Officer

LUTRELLE F. PARKER
Acting Commissioner of Patents and Trademarks